US005427073A

United States Patent [19]

Timms et al.

[11] Patent Number: 5,427,073

[45] Date of Patent: Jun. 27, 1995

[54] FUEL PUMP

[75] Inventors: Colin T. Timms, Harrow; Edward R. Lintott, London, both of United Kingdom

[73] Assignee: Lucas Industries Public Limited Company, Solihull, England

[21] Appl. No.: 244,884

[22] PCT Filed: Dec. 2, 1993

[86] PCT No.: PCT/GB93/02480

§ 371 Date: Jun. 13, 1994

§ 102(e) Date: Jun. 13, 1994

[87] PCT Pub. No.: WO94/12787

PCT Pub. Date: Jun. 9, 1994

[30] Foreign Application Priority Data

Dec. 3, 1992 [GB] United Kingdom ..... 9225341

[51] Int. Cl.[6] ..... F02M 37/04

[52] U.S. Cl. ..... 123/508; 123/506

[58] Field of Search ..... 123/500, 501, 503, 506, 123/508, 507, 509; 239/88–95

[56] References Cited

U.S. PATENT DOCUMENTS

| | | | |
|---|---|---|---|
| 2,019,650 | 11/1935 | Bischof | 123/503 |
| 2,225,019 | 12/1940 | Reteh | 123/500 |
| 2,396,602 | 3/1946 | Posch | 123/500 |
| 4,505,245 | 3/1985 | Lintott | 123/451 |
| 4,615,323 | 10/1986 | LeBlanc | 123/508 |
| 4,714,066 | 12/1987 | Jordan | 123/447 |
| 5,007,401 | 4/1991 | Grohn | 123/509 |

FOREIGN PATENT DOCUMENTS

| | | | |
|---|---|---|---|
| 0237071 | 9/1987 | European Pat. Off. . | |
| 740091 | 1/1933 | France . | |
| 58-178864 | 10/1983 | Japan . | |
| 0204962 | 11/1983 | Japan | 123/508 |
| 2131873 | 6/1984 | United Kingdom . | |

*Primary Examiner*—Carl S. Miller

*Attorney, Agent, or Firm*—Jacobson, Price, Holman & Stern

[57] ABSTRACT

A unit injector for supplying fuel to an internal combustion engine has a bore (21) in which is mounted a pair of plungers (22) extending from the opposite ends of the bore. The plungers are actuated by cams (26) which are mounted on a pair of cam shafts of the engine.

10 Claims, 4 Drawing Sheets

FUEL PUMP

This invention relates to a so called unit injector for supplying fuel to a combustion chamber of an internal combustion engine, and of the kind comprising a body part to which is secured a fuel injection nozzle which defines an outlet orifice, a pumping plunger slidable within a bore in the body part, the plunger extending from one end of the bore and being movable inwardly into the bore to displace fuel from the bore to the injection nozzle, by an engine driven cam and a valve operable to control the amount of fuel delivered through the nozzle.

The object of the invention is to provide a unit injector of the kind specified in a simple and convenient form.

According to the invention in a unit injector of the kind specified an additional plunger is provided the additional plunger being slidable within and extending from the other end of the bore for actuation by a further engine driven cam.

An example of a unit injector in accordance with the invention will now be described with reference to the accompanying drawings in which.

Figure 1:
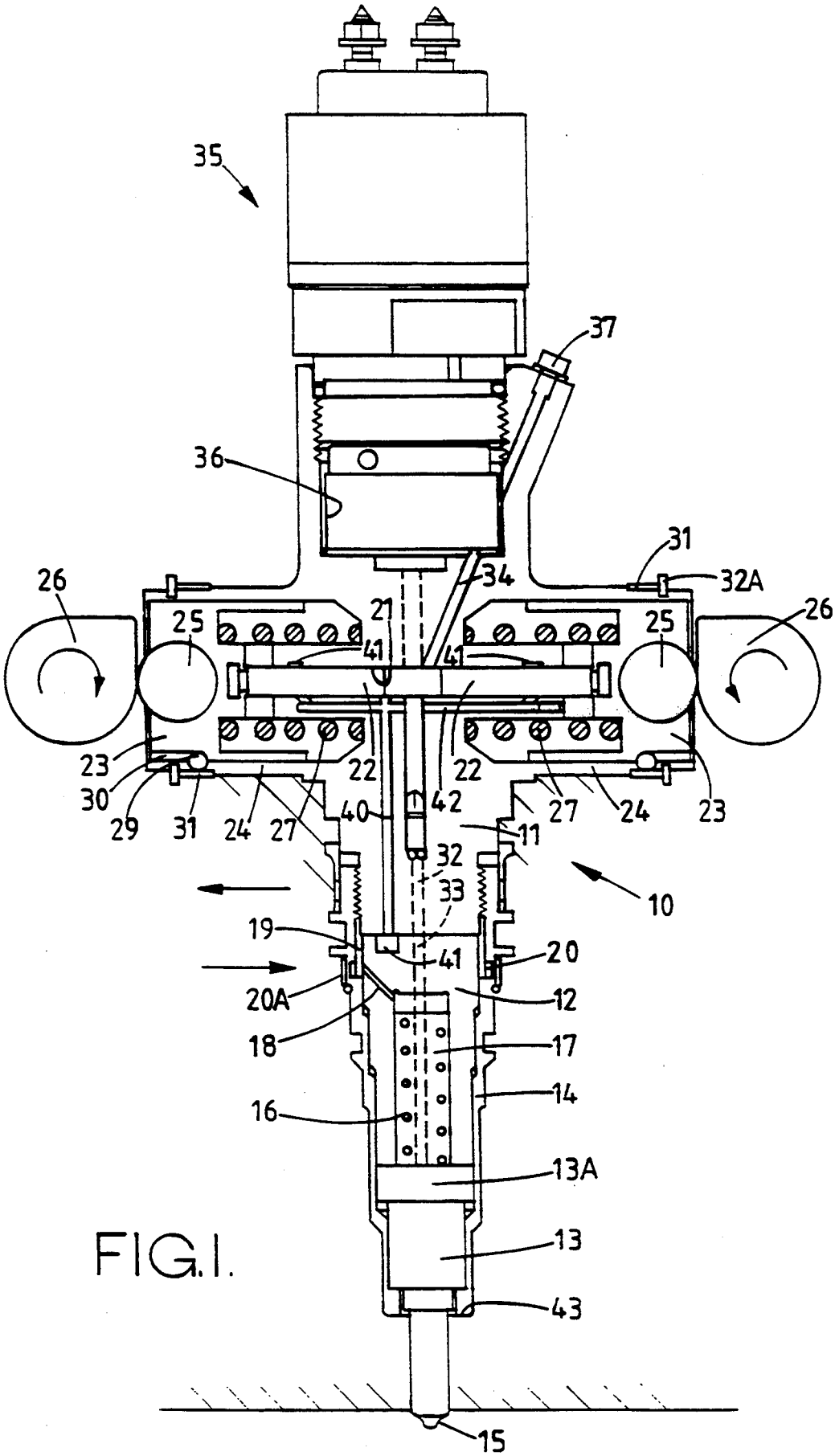
FIG. 1 is a side elevation of the unit injector.
Figure 2:
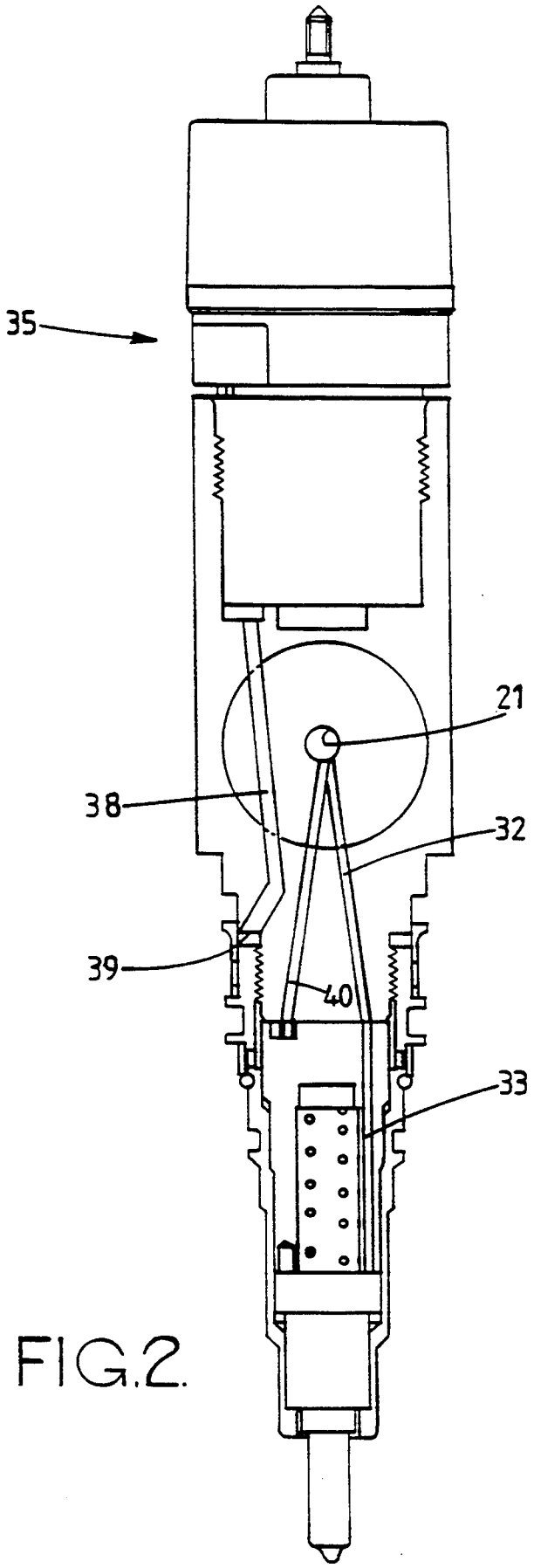
FIG. 2 is a view taken at right angles to FIG. 1.

Referring to FIGS. 1 and 2 of the drawings, the unit injector comprises a body part 10 from which extends a cylindrical screw threaded extension 11. Located in sealing engagement against the end face of the extension 11 is one end of a cylindrical distance member 12 against the other end of which is located in sealing relationship, a distance piece 13A against which is located a fuel injection nozzle 13. The injection nozzle body, the distance piece 13A, the distance member 12 and the extension 11 are held in assembled relationship by means of a cap nut 14.

The fuel injection nozzle 13 includes the nozzle body and a valve member (not shown) which is slidable within the nozzle body in known manner. The valve member defines an annular area against which fuel under pressure can act to lift the valve member from a seating thereby to allow fuel flow through an outlet orifice formed in the tip 15 of the nozzle body.

Movement of the valve member of the nozzle under the action of the fuel pressure is opposed by the action of a spring 16 which is housed within a chamber 17 formed in the distance member 12. The inner end of the chamber communicates byway of a drilling 18 with an annular fuel inlet chamber 19 which is disposed between the exterior surface of the distance member and the inner surface of the cap nut and the chamber communicates by way of inlet openings 20 formed in the wall of the cap nut 14, with a fuel supply gallery defined by the wall of the bore in the cylinder head of the engine in which the injector is located. A fuel filter 20A surrounds the openings.

Formed in the body part 10 is a transverse bore 21 the axis of which extends in a plane at right angles to the axis of the extension 11 and mounted in the bore is a pair of pumping plungers 22 which extend outwardly from the opposite ends of the bore. The plungers are coupled to a pair of tappets 23 respectively and the tappets 23 are of cylindrical form and are slidable within hollow guide sleeves 24 which are integrally formed with the body part 10. The tappets carry rollers 25 respectively for engagement with cams 26 mounted on contra rotating cam shafts of the associated engine. The cam shafts mount additional cams for operating the inlet and exhaust valves of the engine.

The connection between the plunger and its associated tappet is of the T slot variety and is deliberately slack to minimise the possibility of any side thrust being imposed on the plungers. The tappets are biased outwardly by means of coiled compression springs 27 which by virtue of the form of connection between the plungers and the tappets also urge the plungers outwardly.

In order to prevent rotation of the tappets each guide sleeve 24 is provided with a circular opening in which is located a ball 29 which rides in a groove 30 formed in the tappet body. The balls 29 also act to prevent the tappets being moved outwardly by the springs before the injector is assembled to the associated engine. Conveniently the balls are retained within the apertures by band like retaining members 31 which surround the respective guide sleeves and the retaining members are held in position against steps in the peripheral surface of the guide sleeves, by circlips 32A.

The space intermediate the inner ends of the plungers constitutes the pumping chamber of the injector and this is connected by way of a first passage 32 in the injector body part 10, with a passage 33 formed in the distance member 12, and the distance piece 13A and which communicates with the injection nozzle inlet. In addition the pumping chamber is connected by way of a passage 34 shown in FIG. 1, with the inlet of an electromagnetically operable spill valve 35 which is secured within a recess 36 defined in the injector body. Conveniently the passage 34 is drilled obliquely within the injector body part and the passage intersects the recess 36. The outer portion of the passage is closed by a plug 37. The outlet of the spill valve 35 is connected by means of a passage 38 which is seen in FIG. 2, with an outlet 39 and this communicates when the injector is assembled to the engine, with an outlet gallery formed in the cylinder head of the engine.

Fuel is supplied to the pumping chamber through a passage 40 which opens into the bore 21 at a position so that it is uncovered during the outward movement of the plungers. The other end of the passage 40 opens into a channel 41 which is formed in the distance member and which communicates with the inlet chamber 19.

When the injector is assembled into the engine the rollers 25 engage the surfaces of the cams 26 so that the balls 29 are relieved of the loading due to the springs 27. At the outermost positions of the plungers as shown, the entrance of the passage 40 into the bore 21 is uncovered and the pumping chamber will be completely filled with fuel. As the plungers are moved inwardly some fuel will be discharged through the passage 40 until the entrance is covered whereafter the fuel displaced by the pumping plungers will either flow to the fuel injection nozzle and hence to the associated engine if the spill valve is closed or if the spill valve is open, will flow through the passage 34 and the passage 38 to the outlet 39. The spill valve is used to determine the instant at which fuel is delivered to the engine and also the quantity, of fuel which is supplied to the engine. The high fuel pressure which is generated within the pumping chamber during delivery of fuel to the engine, will cause leakage of fuel along the working clearances defined between the plungers 22 and the bore 21 and this leakage fuel is collected in circumferential grooves 41 which are formed in the wall of the bore adjacent its ends. The grooves 41 communicate with the passage 40 by way of a drilling 42 which intersects the passage 40 and which is plugged at its open end.

The unit injector is located within a stepped bore formed in the cylinder head of the associated engine. Since it is necessary to prevent escape of gases from the combustion chamber a seal is established between an end surface of the cap nut 14 and a step 43 defined in the bore. An axial force is applied to the body of the injector to maintain the seal.

The provision of two opposed pumping plungers means that the axial forces applied to the plungers by the cams are substantially balanced whereas with the conventional form of unit injector with a single plunger provision has to be made to absorb the force applied to the injector body. Moreover, since in the example, the cams 26 rotate in opposite direction the components of the cam reaction forces at right angles to the axis of the plungers urge the injector body downwardly as seen in the drawing, during delivery of fuel and upwardly when the rollers engage the trailing flanks of the cams.

Figure 3:
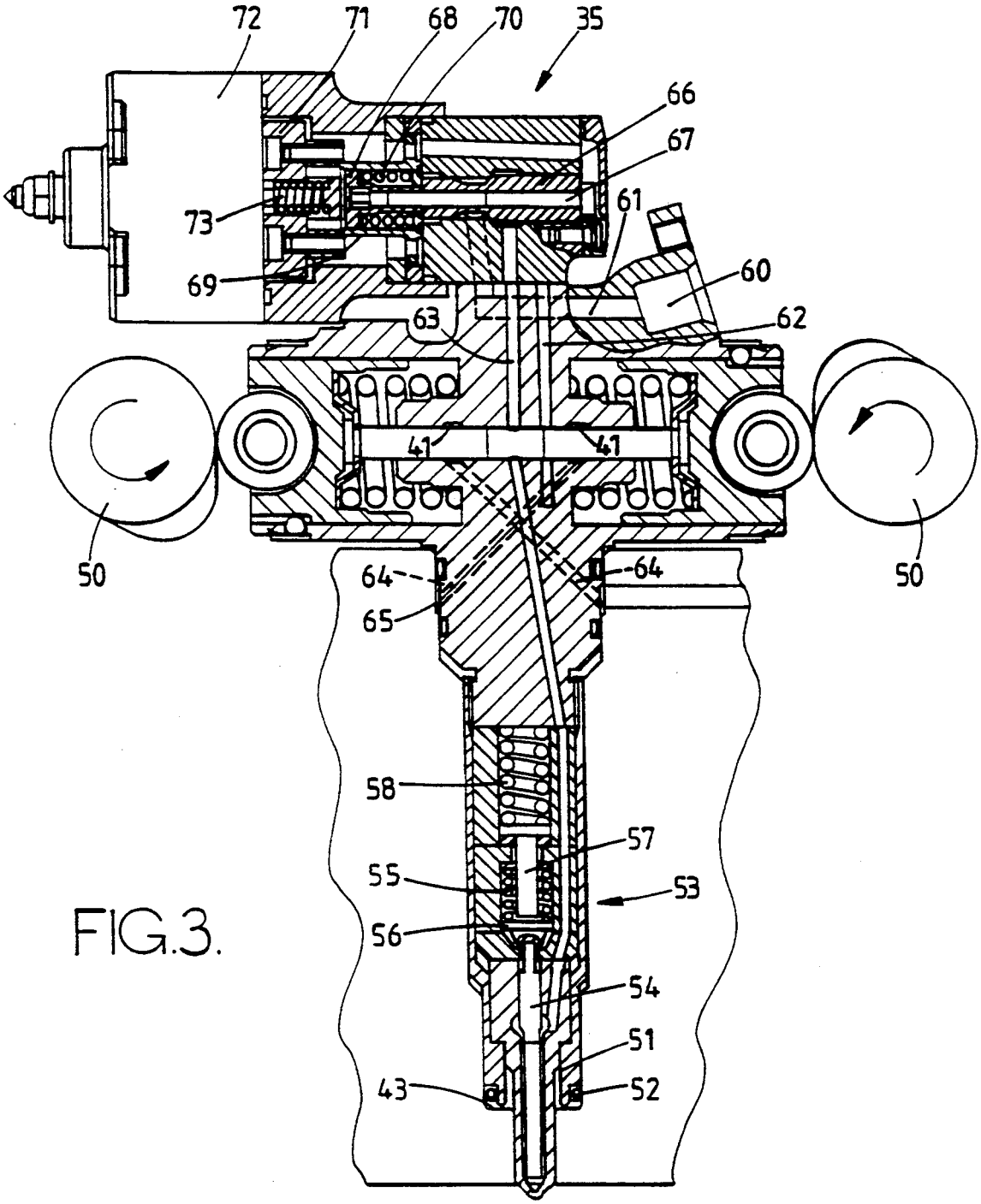
FIGS. 3 and 4 are views similar to FIG. 1 showing modifications.
Figure 4:
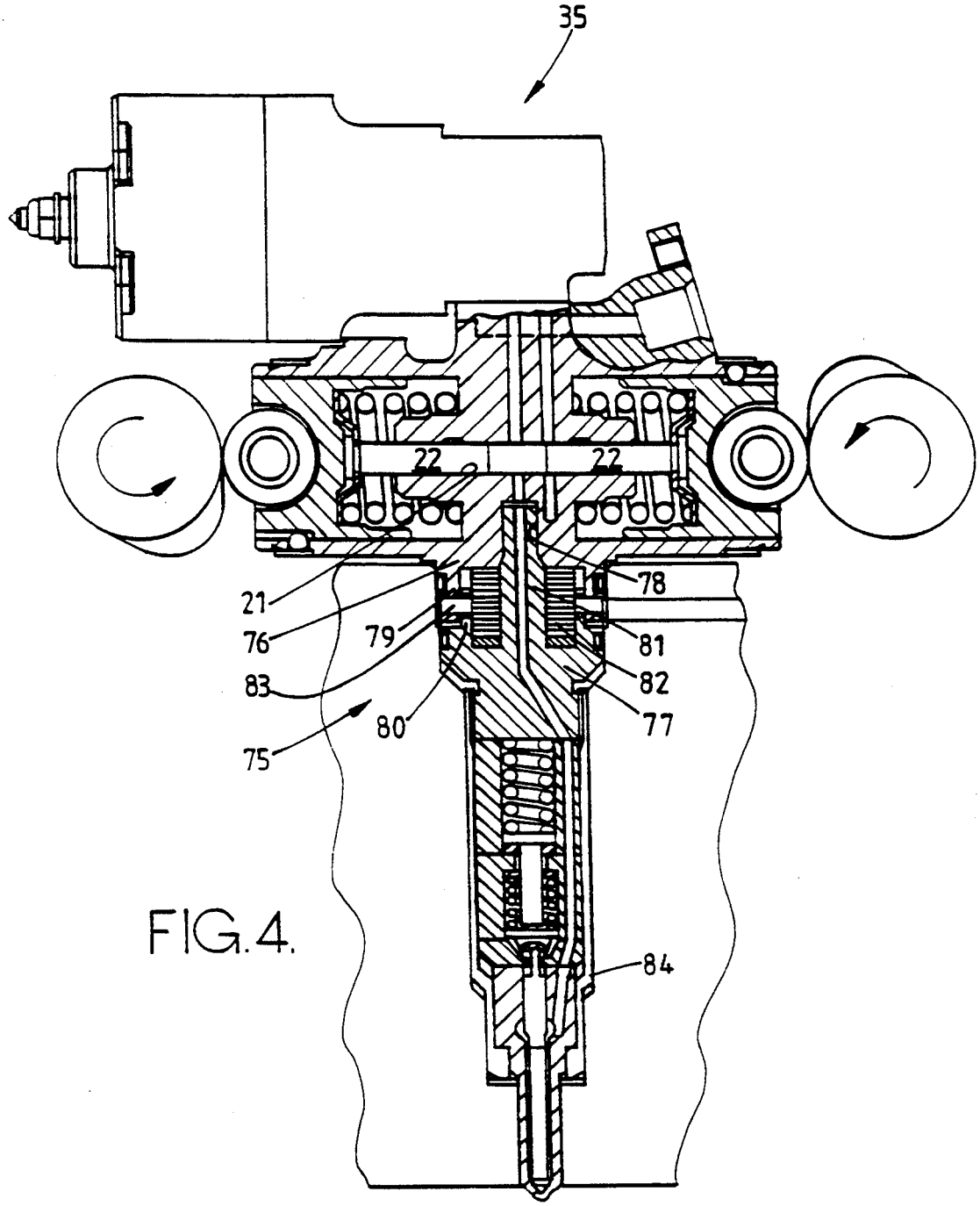

In the examples shown in FIGS. 3 and 4 the cams 50 are mounted on cam shafts which rotate in the same direction. As a result although the axial components of the cam reaction forces remain substantially balanced as in the example of FIGS. 1 and 2, the components of the cam reaction forces at right angles to the axis of the plungers act in opposite directions thereby tending to rock the injector body about a point on the axis of the bore in which it is located. In the example of FIGS. 1 and 2 a seat is maintained between the cap nut 14 and the step 43 by applying an axial force to the body of the injector. In the example of FIG. 3 the cap nut 51 is modified so that when the body of the injector is clamped in position against the cylinder head, the cap nut does not engage the step 43. The gas seal is established by a sealing ring 52 which is located within a recess formed in the cap nut, the sealing ring cooperating with the wall of the bore. Any rocking movement of the injector is therefore accommodated by the seal ring.

FIGS. 3 and 4 also illustrate the use of a two stage fuel injection nozzle 53 in which the valve member 54 is biased into engagement with a seating by means of a first spring 55 acting on the valve member through a spring abutment 56. The initial movement of the valve member under the action of the fuel under pressure is limited by engagement of the spring abutment with a rod 57 which is coupled to a second spring 58. Only when the pressure of fuel has increased does the valve member move against the action of both springs to allow high fuel flow into the combustion chamber of the engine. The two stage nozzle may be incorporated in the example of FIGS. 1 and 2 and vice versa.

The examples of FIGS. 3 and 4 also illustrate the provision of a fuel inlet 60 formed in the portion of the body of the injector which is located beneath the engine cam shaft cover. The fuel inlet is connected to a passage 61 from which extends a passage 62 which is the equivalent of the passage 40 of the examples shown in FIGS. 1 and 2. The passage 61 is also connected to the spill valve 35 to which is also connected a passage 63 which is the equivalent of the passage 34 of the example seen in FIGS. 1 and 2. The grooves 41 which are formed in the wall of the bore which accommodates the pumping plungers and which act to collect fuel leaking between the wall of the bore and the plungers are connected by oblique passages 64 respectively which open into an annular collection space 65 defined between the body of the injector and the wall of the bore in the cylinder head of the engine. The fuel which flows into the collection space is drained from the space through a passage in the cylinder head. The operation of the pumping portion of the injectors shown in FIGS. 3 and 4 is exactly the same as described with reference to FIGS. 1 and 2 except that the fuel which is spilled through the spill valve 35 is returned to the passage 61 and the fuel inlet 60.

FIGS. 3 and 4 also show the construction of the spill valve but also illustrate that it can be turned through 90° in order to reduce the overall height of the injector. The construction of the spill valve is known in the art but suffice to say that it comprises a tubular valve member 66 which is coupled by means of a through bolt 67 to a spring abutment 68. Interposed between the spring abutment and an inwardly extending flange on a tubular member 69 is a coiled compression spring 70. The tubular member is secured to an armature 71 which is associated with a solenoid 72 and when the solenoid is energised an annular seating surface on the valve member is drawn into engagement with a seating defined in the valve body to prevent flow of fuel between the passages 62 and 63. The travel of the armature when the solenoid is energised is greater than that of the valve member so that the spring 70 acts as an overtravel spring. When the solenoid is de-energised the valve member is moved to an open position by the action of a return spring 73.

Turning now to FIG. 4, the extension 75 of the injector body which is located in the bore in the engine cylinder head is formed in two parts 76, 77. The part 76 which is integral with the main portion of the body of the injector is provided with a central recess 78 the inner end of which communicates with the portion of the bore 21 disposed intermediate the plungers 22. Moreover, the part 76 defines an annular skirt portion 79 within which is slidably engaged an annular rim member 80 defined on the part 77. In addition, the part 77 defines a spigot 81 which extends into the recess 78. The spigot is provided with a passage which communicates with the fuel injection nozzle. Surrounding the spigot is resilient means in the form of a stack 82 of Belleville washers and these are located between opposing surfaces on the parts 76, 77 respectively. The two parts are retained relative to each other by a plurality of pins 83 which are carried by the skirt portion 79 and which are loosely located within apertures formed in the rim member 80. The cap nut 84 which serves to secure the components of the nozzle to the part 77 is of similar design to the cap nut shown in FIGS. 1 and 2 in that the end of the cap nut forms a seal with the step in the engine bore. When the injector is assembled into the bore the main part of the body is clamped to the cylinder head of the engine and the stack of Belleville washers yield and exert an axial thrust on the part 77 thereby to establish a gas tight seal between the cap nut and the step in the bore in the cylinder head. This seal may be enhanced by the provision of a soft washer. In the use of the injector any rocking motion experienced by the main portion of the body of the injector is accommodated in the connection between the parts 76 and 77 so that the seat established between the cap nut and the cylinder head will remain intact.

We claim:

1. A unit injector for supplying fuel to a combustion chamber of an internal combustion engine comprising a body part (10) to which is secured a fuel injection nozzle (13, 53) which defines an outlet orifice, a pumping plunger (22) slidable within a bore (21) in the body part, the plunger (22) extending from one end of the bore and being movable inwardly into the bore to displace fuel from the bore to the fuel injection nozzle, by an engine driven cam (26, 50) and a valve (35) operable to control the amount of fuel delivered through the nozzle characterised by an additional plunger (22) slidable within and extending from the other end of the bore (21) for actuation by a further engine driven cam (26, 50).

2. A unit injector according to claim 1 characterised by hollow guide sleeves (24) formed integrally with the body part (10), a pair of tappets (23) slidable within the sleeves respectively, said tappets carrying rollers (25) respectively for engagement with the engine driven cams, means coupling the outer ends of the plungers to the tappets respectively and spring means (27) for biasing the tappets and plungers outwardly.

3. A unit injector according to claim 2 including means (29,30) for limiting the extent of outward movement of the tappets.

4. A unit injector according to claim 1 in which the injection nozzle (13, 53) is secured to an extension (75) of the body part (10) characterised in that the extension is formed in two parts (76, 77) with one part (76) being integral with the body part (10) and the other part (77) having the injection nozzle mounted thereon, passage means extending between the two parts, said passage means acting to convey fuel from the bore (26) to the injection nozzle, and resilient means (82) acting between the parts whereby when the body part (10) is clamped to the cylinder head of the engine the resilient means (82) will yield and impose an axial thrust on the other part (77) thereby to establish a gas seal between a part (84) associated with the fuel injection nozzle and a surface defined by the cylinder head.

5. A unit injector according to claim 4 characterised by a recess (78) formed in the one part (76) and a spigot (81) defined by the other part (77), which locates in said recess to allow the rocking movement between the parts, and means (79) acting to prevent separation of the two parts whilst allowing said rocking movement.

6. A unit injector according to claim 5 characterised in that said resilient means comprises a stack (82) of Belleville washers which are located about said spigot (81).

7. An internal combustion engine including a cylinder head in which is defined a plurality of bores opening into the combustion chambers of the engine respectively, a pair of engine driven cam shafts mounted on the cylinder head for actuating the inlet and exhaust valves of the engine, unit fuel injectors mounted in said bores respectively, each unit injector comprising a body part (10) to which is secured a fuel injection nozzle (13, 53) which defines an outlet orifice through which fuel can flow into the associated combustion chamber, each unit injector having a bore (21) in which is mounted a cam actuated pumping plunger (22) movement of which by the cam can displace fuel through said outlet orifice, characterised in that each unit injector includes a further pumping plunger (22) mounted in the bore (21) the plungers extend outwardly from the opposite ends of the bore, the plungers being actuated by cams mounted on the cam shafts respectively.

8. A unit injector according to claim 1 in which the body part (10) is of generally cylindrical form with the fuel injection nozzle (13, 53) being secured at one end thereof characterised in that the bore (21) extends transversely to the longitudinal axis of the body part (10) intermediate the ends of the body part.

9. A unit injector according to claim 8 characterised in that the valve (35) is located at the other end of the body part (10).

10. A unit injector according to claim 9 characterised in that the body part (10) defines integral hollow guide sleeves (24) which surround in spaced relationship, the extending portions of the plungers (22), said guide sleeves having tappets (23) slidable therein and which are coupled to the plungers respectively, the tappets carrying rollers (25) for engagement with the engine driven cams (26).

* * * * *